US008039189B2

(12) United States Patent
Yamaguchi et al.

(10) Patent No.: US 8,039,189 B2
(45) Date of Patent: Oct. 18, 2011

(54) ELECTROPHOTOGRAPHIC DEVELOPER AND CARRIER THEREFOR, CORE MATERIAL PARTICLE FOR CARRIER FOR ELECTROPHOTOGRAPHIC DEVELOPER AND PRODUCTION METHOD THEREOF AND IMAGE FORMING METHOD

(75) Inventors: Kimitoshi Yamaguchi, Numazu (JP); Naoki Imahashi, Mishima (JP); Masashi Nagayama, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 914 days.

(21) Appl. No.: 11/736,351

(22) Filed: Apr. 17, 2007

(65) Prior Publication Data

US 2007/0243482 A1 Oct. 18, 2007

(30) Foreign Application Priority Data

Apr. 17, 2006 (JP) ..... 2006-113661
Apr. 12, 2007 (JP) ..... 2007-105369

(51) Int. Cl.
*G03G 9/113* (2006.01)

(52) U.S. Cl. ..... 430/111.32; 430/111.35; 430/111.33; 399/159

(58) Field of Classification Search ..... 430/111.1, 430/111.35, 111.33, 137.1, 111.32
See application file for complete search history.

(56) References Cited

U.S. PATENT DOCUMENTS 4,075,391 A * 2/1978 Berg et al. ..... 428/407
4,179,388 A * 12/1979 Rahn et al. ..... 430/111.32
5,204,204 A * 4/1993 Shintani et al. ..... 430/111.35
5,395,450 A * 3/1995 Creatura et al. ..... 118/620
5,419,994 A 5/1995 Honjo et al.
6,004,717 A * 12/1999 Creatura et al. ..... 430/137.13
6,146,801 A * 11/2000 Ichikawa et al. ..... 430/111.35
6,235,443 B1 * 5/2001 Kayamoto et al. ..... 430/111.1
6,319,646 B1 * 11/2001 Suganuma ..... 430/111.4
6,326,118 B1 * 12/2001 Silence et al. ..... 430/111.1
6,472,118 B1 10/2002 Yamaguchi et al.
6,528,225 B1 * 3/2003 Mahabadi et al. ..... 430/111.33
(Continued)

FOREIGN PATENT DOCUMENTS

CN 1330258 A * 1/2002
(Continued)

OTHER PUBLICATIONS

Partial Machine Translation of CN 1330258 (Jan. 2002).*
(Continued)

*Primary Examiner* — Christopher Rodee
(74) *Attorney, Agent, or Firm* — Oblon, Spivak, McClelland, Maier & Neustadt, L.L.P.

(57) ABSTRACT

The present invention can provide small-diameter core material particles for electro photographic carrier, the particles that can prevent occurrences of carrier adhesions and reduce toner spent, have excellent durability and cause little fluctuations in image density with a narrow particle diameter distribution, and an efficient, cost-effective production method thereof. That is, the core material particles for electro photographic carrier are particles wherein the weight average particle diameter, Dw, is in the range of 22 μm to 32 μm, the ratio of Dw to the number average particle diameter, Dp, satisfies the condition, $1<Dw/Dp<1.20$, the content of particles smaller than 20 μm in diameter is in the range of 0% by mass to 7% by mass and smaller than 36 μm is in the range of 90% by mass to 100% by mass, and the BET specific surface area is in the range of 300 $cm^2/g$ to 900 $cm^2/g$.

4 Claims, 3 Drawing Sheets

U.S. PATENT DOCUMENTS

| | | | | |
|---|---|---|---|---|
| 6,599,672 | B2 | 7/2003 | Yamaguchi et al. | |
| 6,735,409 | B2 | 5/2004 | Takahashi et al. | |
| 6,739,534 | B2 | 5/2004 | Yamaguchi et al. | |
| 6,743,558 | B2 | 6/2004 | Yamaguchi et al. | |
| 7,192,679 | B2 | 3/2007 | Yamaguchi et al. | |
| 2003/0224279 | A1 | 12/2003 | Kotsugai et al. | |
| 2005/0064315 | A1* | 3/2005 | Yamaguchi et al. | 430/111.31 |
| 2005/0112489 | A1* | 5/2005 | Fujikawa et al. | 430/111.35 |
| 2005/0158643 | A1 | 7/2005 | Yamaguchi et al. | |
| 2006/0057487 | A1* | 3/2006 | Nagayama et al. | 430/109.4 |
| 2006/0210905 | A1 | 9/2006 | Imahashi et al. | |
| 2007/0048650 | A1* | 3/2007 | Inoue et al. | 430/111.33 |
| 2007/0048652 | A1 | 3/2007 | Imahashi et al. | |

FOREIGN PATENT DOCUMENTS

| | | | |
|---|---|---|---|
| EP | 1535670 | A2 | 6/2005 |
| JP | 58-144839 | | 8/1983 |
| JP | 3-233464 | A | 10/1991 |
| JP | 3029180 | | 2/2000 |
| JP | 2001-117285 | | 4/2001 |
| JP | 2001-209215 | | 8/2001 |
| JP | 2005-134708 | | 5/2005 |
| JP | 2005-250424 | | 9/2005 |
| JP | 2006-53515 | | 2/2006 |
| JP | 2007-240615 | A | 9/2007 |

OTHER PUBLICATIONS

U.S. Appl. No. 12/209,607, filed Sep. 12, 2008, Nagayama, et al.
U.S. Appl. No. 12/015,109, filed Jan. 16, 2008, Nagayama, et al.
U.S. Appl. No. 12/013,108, filed Jan. 11, 2008, Yagi, et al.
U.S. Appl. No. 12/040,451, filed Feb. 29, 2008, Saitoh, et al.
U.S. Appl. No. 11/958,728, filed Dec. 18, 2007, Nagayama, et al.
U.S. Appl. No. 12/048,997, filed Mar. 14, 2008, Yamaguchi, et al.

* cited by examiner

ELECTROPHOTOGRAPHIC DEVELOPER AND CARRIER THEREFOR, CORE MATERIAL PARTICLE FOR CARRIER FOR ELECTROPHOTOGRAPHIC DEVELOPER AND PRODUCTION METHOD THEREOF AND IMAGE FORMING METHOD

BACKGROUND OF THE INVENTION

1. Field of the Invention

The present invention relates to a carrier, an electrophotographic developer using the carrier, core material particles for the carrier, a production method of the core material particles and an image forming method using the electrophotographic developer.

2. Description of the Related Art

Developing processes of electrophotography are divided into a so-called one-component developing process only using a toner as a main component, and a so-called two-component developing process using a developer that is a mixture of a toner and a carrier. In such two-component developing process, a carrier is used, and thus the developer used in the two-component developing process, or two-component developer, has a wider area frictionally charged to toner particles. In addition, the two-component developing process is more stable in charge property than the one-component developing process, is advantageous in providing high-quality images over a long period of time and has a high-ability of supplying a toner to areas to be developed. Therefore, the two-component developer has been widely used.

In recent years, developing a developing system that has the capability of developing a latent image precisely has become important in order to correspond to increasing demands for higher resolution and better highlight reproducibility and to wider colorization. Thus, there have been various proposals from the aspect of both process conditions and developers including toners and carriers. From the aspect of the process, minimizing a developing gap, thinning a photoconductor and reducing a writing beam spot diameter are effective ways to correspond to such demands, but these ways increase the production cost and still have an unsolved big issue in, for example, reliability.

That using a small diameter toner in a developer can drastically improve the dot reproducibility is commonly known, however, that developer still has unsolved disadvantages in, for example, occurrence of background smears and inadequacy of image density. And resins with a low flexibility point have been used for small diameter full color toners in order to obtain sufficient color tones, however, using the resins will cause an increase of carrier spent, deterioration of a developer, toner scattering and background smears to the full color toners compared with a black toner.

There have been many proposals on using small diameter carriers. For example, Japanese Patent Application Laid-Open (JP-A) No. 58-144839 proposes a magnetic carrier that is composed of ferrite particles having spinel structures and an average particle diameter of less than 30 μm. This magnetic carrier is, however, not coated with resin and is used under a low developing electric field applied thereon, and has disadvantages in that the carrier has poor developing ability and, because the carrier is not coated with resin, has a short operating life.

Furthermore, Japanese Patent Application Publication (JP-B) No. 3029180 proposes an electrophotographic carrier having carrier particles with a 50% average particle diameter (D50) in the range of 15 μm to 45 μm, and containing particles smaller than 22 μm in diameter in the range of 1% to 20%, smaller than 16 μm in the range of 3% or less, 62 μm or larger in the range of 2% to 15%, and 88 μm or larger in the range of 2% or less, and wherein the specific surface area, S1, of the carrier which is determined by an air permeability method and the specific surface area, S2, of the carrier which is calculated by the equation, $S2=\{(6/\rho)D_{50}\}10^4$ (ρ represents a specific gravity of the carrier), satisfy the condition, $1.2<=S1/S2<=2.0$.

Those small diameter carriers are known to have following advantages;that is, (1) Because of wide surface area per unit volume, toner particles will be given sufficient frictional electrification, and thus occurrences of low charged toner particles and oppositely charged toner particles can be suppressed. And as a result, occurrence of background smears and amount of dust and occurrence of toner blur around toner dots can be suppressed, and thereby high dot reproducibility can be achieved. (2) The average charge amount of the toner particles will be lowered because the carrier has a large surface area per unit volume and less occurrence of background smear, providing sufficient image densities. Therefore, the small diameter carrier particles can cover the shortcomings of using the small diameter toner particles, and are particularly advantageous in taking advantage of the toner particles. (3) The small diameter carrier particles can form a fine magnetic brush and have less tendency of causing blush smears.

Magnetic binding force of such smaller carrier particles, however, dramatically decreases proportionally with the cube of the decrease in the particle diameter, causing many carrier adhesions wherein carrier particles adsorb in a form of cut-off magnetic brush. As a result, such conventional small diameter carriers cause flaws of a photoconductor/fixing roller, and have big issue in practical use.

From a study on carrier particles adhering to a photoconductor, that smaller diameter carrier particles occupy a much greater portion among these adhering carrier particles than larger diameter carrier particles was found. Thus, there have been various proposals on classification steps to obtain carriers having a minimized particle diameter distribution. Among those suggested methods, a classification step using a sieve can provide carriers having a narrow particle diameter distribution and efficiently produce carriers having required particle diameters compared with a centrifugal force method and an air classification method. However, it is commonly known that the sieve classification method has difficulties in producing smaller carrier particles with a narrow particle diameter distribution because of the reduction in the mass per particle. Furthermore, smaller diameter carriers tend to have higher friction between particles and cause an increase in developing sleeve driving torque, resulting in scratching a surface of the sleeve and causing more toner fixations. That increases in friction and torque cause fluctuations in supply amount of developer to the sleeve and in the image density. Carrier particles having small diameters and BET specific surface areas have characteristic that, because of the smooth surface thereof, the carrier particles have small friction between which and require less developing sleeve driving torque, and thereby occurrences of scratching and toner fixation to the sleeve surface are prevented, resulting in less fluctuations in supply amount of developer to the sleeve and in the image density. Such carries having small diameters and BET specific surface areas, however, because of the smooth surface, or higher sphericity in the shape of the carrier particles, tend to be stuck in opens of the sieve, and thus obtaining the carrier particles from the sieve classification method has been particularly difficult. For that reason, obtaining the carries having small diameters and BET specific surface areas (or composed of core material particles having smooth surfaces) and the narrow particle diameter distribution had not been realized.

One proposed method, such as one disclosed in JP-A No. 2001-209215, includes transmitting supersonic vibrations to a metal screen of a classification machine, giving vertical acceleration to particles to thereby efficiently obtain particles 22 μm in diameters or smaller with a narrow particle diameter distribution in order to solve the forementioned problems and to obtain a carrier for an electrophotographic developer that can provide high image quality and high durability, cause less occurrences of carrier adhesions and have the weight average particle diameter (Dw) of from 25 μm to 45 μm, the content of particles 44 μm in diameter or smaller in the range of 70% or more, the content of particles 1.30 μm in diameter or smaller in the range of 7% or less, and the ratio of Dw to the number average particle diameter (Dp) ranging from 1.00 to 1.

This method can efficiently pass small diameter particles through the mesh because that virtical acceleration thereto applied substantially moves the particles as if small particles were having a large mass, or having a large true specific gravity. JP-A No. 2001-209215 further discloses using an ultrasonic transducer equipped with a resonant ring to improve the efficiency of the sieve method. However, when the classification machine uses a mesh having small openings, since the mesh is made with thin material and thus strength thereof is weak (as the mesh material is made with thin threads), a part of the edge of the mesh can easily broken due to the weight of the carrier particles after being used for a long time, resulting in that unclassified fine particles are mixed into the classified carrier particles, increasing the content of the fine particles. Furthermore, maintaining the classification performance over classification processes for particles having small particle diameters and BET specific surface areas is difficult even when a vibrating screen using the ultrasonic transducer equipped with the resonant ring is in use. That is because of occurrence of mesh clogging that was particularly big issue. Particles having small BET specific surface areas increase contact areas of the particles and the mesh threads and resistance of the particles to pass through the mesh, resulting in frequent occurrences of mesh clogging. Smaller diameter particles have higher tendency to cause the mesh clogging. When the mesh is clogged, as the carrier particles hide among the openings, it is quite difficult to remove the carrier particles, requiring an exchange of the mesh.

While some meshes are woven with resin threads, stainless steel is usually used therefor. That is because the resin threads has a small stiffness, and thus ultrasonic sound cannot be effectively transmitted to the mesh and classfication may be prevented at all. On the other hand, production costs of a stainless steel mesh having small openings are extremely high, resulting in higher carrier production costs.

BRIEF SUMMARY OF THE INVENTION

An object of the present invention is to solve the forementioned problems by providing small diameter core material particles for an electrophotographic carrier that can prevent such problems, and more specifically, to provide the core material particles that can provide high image quality and particularly excellent granularity, prevent occurrence of carrier adhesions and require less developing sleeve driving torque and thereby the core material particles can minimize toner spent, have a high durability, small BET specific surface areas and a narrow particle diameter distribution and prevent fluctuations in supply amount of developer and in image density, and to provide a classification step for the core material particles for the electrophotographic carrier, the step that can efficiently and cheaply produce the core material particles.

The inventors of the present invention conducted examination to solve the forementioned problems and found that the core material particles for the electrophotographic carrier, which has small particle diameters, a specific particle diameter distribution wherein the content of small diameter particles is small and small BET specific surface areas, can be obtained through the following carrier, electrophotographic developer using the carrier, core material particles for the carrier, production method of the core material particles and image forming method using the electrophotographic developer.

That is, the following specific methods were found:

<1> A carrier for an electrophotographic developer, comprising:

magnetized core material particles and a resin layer covering each surface thereof, wherein the weight average particle diameter, Dw, of the core material particles is in the range of 22 μm to 32 μm, the ratio of Dw to the number average particle diameter, Dp, satisfies the condition, $1<Dw/Dp<1.20$, the content of particles smaller than 20 μm in diameter is in the range of 0% by mass to 7% by mass, the content of particles smaller than 36 μm in diameter is in the range of 90% by mass to 100% by mass, and the BET specific surface area of the core material particles is in the range of 300 $cm^2/g$ to 900 $cm^2/g$.

<2> The carrier according to item <1>, wherein the BET specific surface area of the core material particles is in the range of 300 $cm^2/g$ to 800 $cm^2/g$.

<3> A production method of core material particles, comprising:

conducting a smoothing treatment to the surface of the core material particles, and classifying the core material particles using a vibrating sieve having an oscillator which includes an ultrasonic transducer to thereby obtain a carrier core material, wherein the vibrating sieve comprises at least an upper mesh and a lower mesh which are layered on the ultrasonic transducer, wherein the lower mesh receives a vibration from the ultrasonic transducer and transmits the vibration to the upper mesh to thereby classify the smoothing treated-core material particles, and wherein the core material particles have the weight average particle diameter, Dw, thereof is in the range of 22 μm to 32 μm, the ratio of Dw to the number average particle diameter, Dp, satisfies the condition, $1<Dw/Dp<1.20$, the content of particles smaller than 20 μm in diameter is in the range of 0% by mass to 7% by mass, the content of particles smaller than 36 μm in diameter is in the range of 90% by mass to 100% by mass, and the BET specific surface area of the core material particles is in the range of 300 $cm^2/g$ to 900 $cm^2/g$.

<4> The production method according to item <3>, wherein the upper mesh has small openings, and the lower mesh has large openings.

<5> The production method according to one of items <3> and <4>, wherein at least one upper mesh is made of a material having a bending elastic modulus of 1 GPa to 10 PGa.

<6> The production method according to any one of items <3> to <5>, wherein the vibrating sieve comprises a sympathetic vibration part fixed to the meshes, and the sympathetic vibration part resonates with an ultrasonic vibration transmitted thereto and thereby transmits the vibration to the uppermost mesh.

<7> The production method according to any one of items <3> to <6>, wherein both finer particles and coarser particles are classified.

<8> The production method according to any one of items <3> to <7>, wherein the upper mesh is made of resin.

<9>The production method according to item <8>, wherein the mesh made of resin is woven with nylon threads.

<10> The production method according to item <8>, wherein the mesh made of resin is woven with polyester threads.

<11> Core material particles for a carrier for an electrophotographic developer, wherein the core material particles are obtained by the production method according to any one of items <3> to <10>.

<12> An electrophotographic developer, comprising:

a toner and the carrier according to one of items <1> and <2>.

<13> An image forming method, comprising:

forming a toner image on a photoconductor using the developer according to item <12>, transferring the toner image on a recording medium, and fixing the toner image transferred onto the recording medium.

According to the present invention, small diameter core material particles for electrophotographic carriers having small BET specific surface areas and a narrow particle diameter distribution can be obtained with a low production cost by using a pair of meshes, which are provide on an ultrasonic transducer and composed of a mesh having a classification function and a mesh having a function to strengthen the other mesh, and a mesh used as an upper mesh preferably has a lower degree of elasticity than a mesh used as a lower mesh. Furthermore, carriers and a developer that can provide a high image density and an excellent uniformity in highlight and cause less occurrence of background smears and carrier adhesions can be achieved by using carrier core material having a specific narrow particle diameter distribution and small particle diameters. Furthermore, the carrier of the present invention requires less developing sleeve driving torque, has excellent durability and causes less fluctuation in supply amount of developer and in image density. And small diameter core material particles for an electrophotographic carrier, the core material having small BET specific surface areas and a narrow particle diameter distribution, can be efficiently produced. And further, the core material particles for the electrophotographic carrier, the carrier and the developer which have excellent durability, can minimize toner spent, prevent occurrence of background smears and provide a high image density and an excellent uniformity in highlight and cause less occurrence of carrier adhesions and less fluctuation in supply amount of developer and in image density.

DETAILED DESCRIPSION OF THE INVENTION

Figure 1:
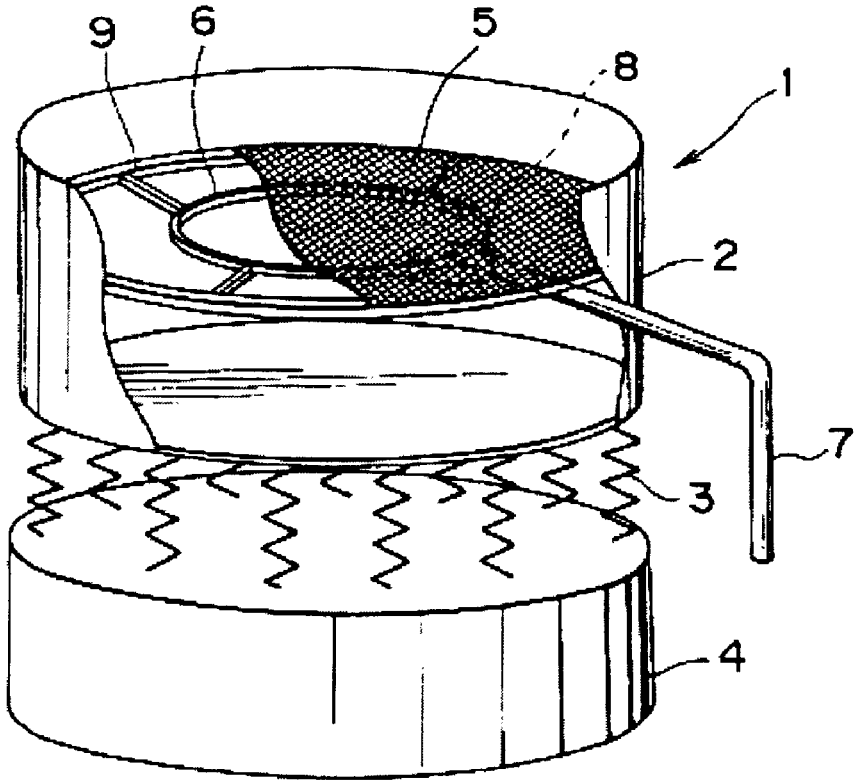
FIG. 1 is a perspective diagram showing the construction of the vibrating sieve equipped with an ultrasonic oscillator of the present invention.

Other features and advantages of the core material particles for electrophotographic carrier, the production method thereof, the carrier using the core material particles and the developer using the carrier of the present invention will be described in the further detail by way of example with reference to the accompanying drawings. The small diameter core material particles for the electrophotographic carrier of the present invention which have small BET specific surface areas and a narrow particle diameter distribution can be produced by classifying the core material particles using a vibrating sieve having an oscillator which includes an ultrasonic transducer and two or more layered meshes provided on the ultrasonic transducer, wherein one of the meshes serving as a lower or lowermost mesh receives vibration from the ultrasonic transducer and transmits that received vibration to the other mesh serving as an upper mesh or uppermost meshes to thereby classify the carrier provided on the upper mesh, and the bending elastic modulus of the upper mesh is preferably in the range of 1 Gpa to 10 Gpa.

When two meshes are layered and provided with the ultrasonic transducer, openings of the upper mesh, which has a classification function, are preferably smaller than that of the lower mesh, which serves to transmit ultra sonic vibration transmitted from the ultrasonic transducer and substantially has a function to strengthen the upper mesh, and thereby the load given to the upper mesh during vibration screening is reduced and the life thereof is drastically extended.

The lower mesh is preferably made of material and preferably has openings that are adequate to transmit vibration well, and is woven of, for example, thick threads that have a high durability against friction and a high tenacity. It is preferred that the openings of the lower mesh be substantially larger than the largest diameter of particles. The openings of the lower mesh of 62 μm (or mesh 250) or larger should be adequate for classifying the core material particles, which have the weight average particle diameter, Dw, of 22 μm to 32 μm, used for the electrophotographic carrier of the present invention. The openings are, however, preferably around 104 μm (or 150 mesh) for classifying the core material particles having Dw of 22 μm to 32 μm, as thicker mesh threads make it harder to transmit ultra sonic vibration. In addition, the lower mesh is preferably formed of a hard metallic material having a flexural modulus of from 50 GPa to 500 GPa to efficiently transmit ultra sonic vibration. The mesh may be layered more than two meshes, wherein lower mesh(es) has a supporting function and upper mesh(es) has a classifying function. The upper mesh(es) can be selected from those having suitable openings for classifying particles with diameters to be classified. Because the lower mesh(es) is provided under the upper mesh(es), the upper mesh(es) can have larger opening ratios.

When the vibrating sieve having the ultrasonic oscillator used for the classification step of the production method of the present invention has a resonant member provided thereunder, ultra sonic vibration can be uniformly transmitted to the entire screen and meshes through a resonant ring, and thereby particles on the meshes can be efficiently sieved. That ultra sonic vibration used for vibrating the meshes can be generated from converting high-frequency current into ultra sonic vibration through a converter. The converter includes a transducer piezoelectric material such as a PZT transducer. Ultrasonic vibration, generated by the converter, is transmitted to the resonant member provided under the meshes, and the resonant member vibrates sympathetically and then vibrates the meshes fixed thereon. Frequency of that vibration transmitted to vibrate the meshes is preferably in the range of from 20 kHz to 50 kHz, and more preferably of from 30 kHz to 40 kHz. Any shape can be used for the resonant member as long as the shape is in an adequate form for vibrating the meshes, and normally a ring type is used therefor. Vibration direction of the meshes is preferably vertical.

FIG. 1 schematically shows an example of a vibrating sieve equipped with an ultrasonic oscillator used for the classification step of the production method of the present invention. In FIG. 1, numeral 1 is a vibrating sieve, 2 is a cylindrical container, 3 is a spring, 4 is a base (support), 5 is two or more stacked layered-meshes and the lower mesh(es) have large openings, 6 is a sympathetic vibration part (in this example, the resonant member is ring-shaped), 7 is a high-frequency current cable, 8 is a converter and 9 is a ring-shaped frame. High-frequency current is supplied to the converter (8) through the cable (7) in order to activate the vibrating sieve equipped with the ultrasonic oscillator (circular screener) shown in FIG. 1. High-frequency current supplied to the converter 8 will be then converted into super sonic waves. That ultrasonic vibration generated by the converter 8 will then vertically vibrates the sympathetic vibration part 6 thereon the converter 8 is fixed and the ring-shaped flame 9 which is linked to the resonant ring 6. Vibration transmitted to the sympathetic vibration part 6 will thus vertically vibrate the meshes 5, which is fixed on the frame 9 and the sympathetic vibration part 6. A marketed vibrating sieve equipped with an ultrasonic oscillator can be used, and examples thereof include ULTRASONIC (available from Koei Sangyo Co., Ltd.).

Any particles which are not at all classified, or classified by air or mechanically, can be classified by the classification step of the production method of the present invention. Further, fine particles, coarse particles or the both particles can be classified by the classification step according to particle diameter distributions of those particles. Particularly, the classification step of the present invention is preferably used for classifying the coarse particles because a sharper particle diameter distribution can be obtained by this step than other classification steps such as an air classifying step and particles having desired particle diameters can be efficiently obtained.

The upper mesh(es) may be woven with thin threades or made of mesh materials having holes cut by a laser or an etching process. However, since the carriers have small diameters, smooth surfaces and small BET specific surface areas, the particles tend to cause occurrences of mesh clogging, and thus a fibrous mesh woven with a material, which can be selected from various materials, should preferably be used for the upper mesh(es). Further, the upper mesh(es) is preferably formed of materials having an adequate bending elastic modulus, which is preferably in the range of from 1 GPa to 10 GPa.

When the upper mesh(es) has smaller elasticities than the lower mesh(es), vibration transmitted from the lower mesh(es) will slightly transform the openings of the upper mesh(es), preventing mesh clogging, and thereby higher efficiency of the classification can be achieved. When the upper mesh(es) has a bending elasticity of greater than 10 GPa, the openings thereof are less transformed and the mesh tends to be clogged, decreasing the efficiency of the classification. And when less than 1 GPa, the upper mesh(es) absorbs the vibration of the lower mesh(es) and the openings of the upper mesh(es) are excessively transformed, decreasing the efficiency of the classification.

Materials used for the upper mesh(es) are not particularly limited, provided the materials have bending elasticity in the range of from 1 to 10 GPa, but the materials are preferably resins because of lower production costs thereof. Resin meshes having smaller openings have higher cost-effectiveness. For example, the production costs per unit area of a polyamide mesh (known as nylon mesh) having openings of about 20 μm is about 1/20 of that of an equivalent stainless steel mesh. When the upper mesh(es) is provided with no lower mesh, the durability of the upper mesh(es) having small openings and a moderate elasticity is insufficient, and thus such mesh(es) is not suitable to be used in the ultrasonic vibrating sieve. Therefore, when used together with lower mesh(es) having a sufficient bending elastic modulus, from 50 Gpa to 500 Gpa, the ultrasonic vibrating sieve has better classifying preciseness and efficiency.

The methods of preparation and materials of the resin mesh are not particularly limited except for the bending elastic modulus. Known resins such as a polyamide resins, polyester resin, acrylic resins and fluorocarbon resins can be used, provided they can form a mesh. Among the resins, the nylon resins are preferably used because of excellent durability and chemical resistance thereof, and the polyester resins are preferably used because of durability and environmental resistance thereof. Marketed nylon meshes and polyester meshes such as NYTAL (RTM) and PETEX (RTM) series from Sefar Holding Inc. in Switzerland can be used. When the fibrous resin is woven, only one of either a warp or a weft may be used.

A mesh having a bending elasticity not greater than 10 GPa occasionally has an insufficient strength when having no mesh beneath and is not suitable to be used for the ultrasonic vibrating sieve. However, as mentioned above, the double mesh has a sufficient strength and durability, and the resultant vibrating sieve has excellent classifying preciseness and efficiency.

The bending elastic modulus of a mesh can be measured according to the standard stated in D790 of ASTM (American Society for Testing and Materials). The bending elastic modules in the present invention were measured according to that standard of ASTM D790.

The core material particles for the electrophotographic carriers classified by the classification method of the present invention have a narrow particle diameter distribution, and when they have the weight-average particle diameter (Dw) in the range of from 22 μm to 32 μm, the ratio of the weight average particle diameter (Dw) to the number average particle diameter (Dp) in the range of 1.00 to 1.20 (not inclusive), the content of the particles having diameters of less than 20 μm in the range of 0% by mass to 7% by mass, the content of the particles having diameters less than 36 μm in the range of 90% by mass to 100% by mass, and BET specific surface areas in the range of 300 $cm^2/g$ to 900 $cm^2/g$, an excellent performance of the core material particles can be obtained. Furthermore, the carriers obtained by having the core material particles covered with resin can provide high image quality and excellent granularity, require less developing sleeve driving torqu, and cause less fluctuation in supply amount of developer and in image density and occurrences of background smears.

Carriers having a smaller weight-average particle diameter (Dw) can provide better granularity (or higher uniformity of highlight image), however, such carriers tend to cause carrier adhesions. Once the carrier adherence occurs, the granularity will be degraded. On the contrary, carriers having a larger weight-average particle diameter (Dw) have less tendency to cause carrier adhesions, but when the toner concentration is increased to thereby increase the image density, occurrences of background smears will be increased. The term "carrier adhesion" mentioned here represents a phenomenon wherein carrier particles adhere to image portions and/or background portions of a latent electrostatic image. Although stronger electric field will cause carrier adhesions more frequently, the image portions tend to have few occurrences of carrier adhesions compared with the background portions because the electric field of the image portions is decreased through toner development. Particularly, when the weight average particle diameter (Dw) of the carriers is in the range of 22 μm to 32 μm, increasing the toner concentration will not increase the occurrences of the background smears, thus both excellent image quality and granularity can be obtained. In addition, a carrier, which has the content of the particles having diameters of less than 36 μm in the range of from 90% by mass to 100% by mass, the content of the particles having diameters of less than 20 μm in less than 7% by mass, or preferably less than 5% by mass, and the ratio of (Dw/Dp) in the range of from 1.00 to 1.20, or preferably from 1.00 to 1.18, is turned out to be a carrier that can solve the problem of the occurrences of carrier adhesions.

Furthermore, smaller diameter carrier particles tend to have higher friction between the carrier particles, resulting in an increase in the developing sleeve driving torque and a decrease in the flowability of the carrier. The size of the BET specific surface areas of the carrier particles has a larger influence on smaller diameter carrier particles. In that case, larger BET specific surface areas of the carrier particles have nonsmooth surfaces, will increase the developing sleeve driving torque and cause more frequent occurrences of toner fixation to the sleeve and sleeve surface cracking and fluctuations in the amount of developer supplied to the sleeve and in the image density. Moreover, toner spent will be increased and the electrification amount of developer will be degraded.

The BET specific surface areas of the core material particles for a electrophotographic carrier of the present invention is preferably in the range of 300 $cm^2/g$ to 900 $cm^2/g$, and more preferaby 300 $cm^2/g$ to 800 $cm^2/g$. When the BET specific surface areas are smaller than 300 $cm^2/g$, even the classification step of the present invention which uses layered meshes cannot maintain its excellent classification performance. And when the BET specific surface areas are larger than 900 $cm^2/g$, the developing sleeve driving torque will be increased, resulting in fluctuations in the supplied developer amount and deterioration of the developer.

The BET specific surface areas of the core material particles for the electrophotographic carrier are measured based on a surface area per unit volume, which can be given by measuring adsorption of nitrogen, absorbed by a sample, and a pressure change at adsorption, using a BET equation. The measuring was conducted using a Micromeritics specific surface area automatic measurement machine (TriStar3000/Surface Area and Porosity Analyzer).

Known magnetic materials can be used for the core material of the carrier of the present invention. The carrier core material particles used in the present invention have a magnetic moment of 40 emu/g or more, and preferably 50 emu/g or more, when a magnetic field of 1,000 Oersted (Oe) is applied thereto. The maximum value of the magnetic moment is not particularly limited, but usually about 150 emu/g. When the magnetic moment is less than 50 emu/g, occurrences of carrier adhesions will be increased, and thus using the carrier core material particles having that magnetic moment is not preferred.

The magnetic moment of a carrier can be measured as follows. Carrier core material particles weighing 1.0 g are filled in a cylindrical cell of a B-H tracer (BHU-60, manufactured by Riken Denshi Co., Ltd.), and the cylindrical cell was set to the tracer. A magnetic field is applied thereto and gradually increased up to 3,000 Oersted, and is gradually decreased to 0 Oersted. Then, a reverse magnetic field is applied and gradually increased up to 3,000 Oersted. After slowly decreasing the magnetic field until it reaches 0 Oersted, it is again increased in the first direction. A B-H curve can be illustrated with this means, and the magnetic moment at a magnetic field of 1,000 Oersted can be given with the curve.

Examples of core materials used for particles, which can have 40emc/g magnetic moment when a 1,000 Oersted magnetic field is applied thereon, are ferromagnetic materials such as irons and cobalts, magnetites, hematites, Li ferrites, Mn—Zn ferrites, Cu—Zn ferrites, Ni—Zn ferrites, Ba ferrites and Mn ferrites. In this case, a ferrite is a sinter which can be usually represented by the following formula (1):

$$(MO)_x(NO)_y(Fe_2O_3)_z \quad (1)$$

wherein x+y+z=100 mol %; and M and N represent metal atoms such as Ni, Cu, Zn, Li, Mg, Mn, Sr and Ca, and are composed of a perfect mixture of divalent metal oxide and trivalent iron oxide.

The core material particles for the electrophotographic carrier of the present invention, the core material particles having a weight average particle diameter (Dw) in the range of 22 μm to 32 μm and smooth surfaces which have the BET surface area in the range of 300 $cm^2/g$ to 900 $cm^2/g$, can be obtained by adjusting a firing condition or by a smoothing treatment in which heat, nitrogen and/or oxygen are used. They can also be obtained by changing the composition of core material.

Core material particles which have higher sphericity, smaller diameters and, specifically, smooth surfaces and small BET surface areas can be obtained by the method described below.

By adjusting the firing condition in a dry-calcinating method, the shape of the carrier core materials and surface smoothness (BET surface area) thereof can be controlled.

When the carrier core material is made of ferrite, a smoothing treatment thereto is conducted as follows. The carrier made of the ferrite can be obtained by, for example, a metal oxide-granulation object which is made of sprayed, dried slurry.

The carriers made of ferrite can be obtained by, for example, by further calcinating particles that is obtained by spraying and drying slurry containing metal oxides and dispersants.

By conducting the calcination of the metal oxide-granulation object in a rotary kiln, carrier core material particles whose surface is treated with the smoothing treatment can be obtained. By adjusting the rotating speed, heat time and heat temperature of the rotary kiln, the BET specific surface area of the surface of ferrite (carrier core material) can be controlled.

Additionally, surface smoothness of the carrier core material particles and the BET specific surface area thereof can be controlled and minimized by adjusting sintering temperature and time without turning the granulation object in the rotary kiln. Usually, the sintering temperature for the ferrite is in the range of 1,000° C. to 1,400° C. Grainsize of the ferrite can be controlled by adjusting the sintering temperature. When the grainsize is larger, the asperity of the surface will be reduced and the BET specific surface area will be smaller. However, it is difficult to obtain a BET specific surface area, desirable in the present invention by adjusting only the sintering temperature and time. Conducting the calcination in the turning kiln is necessary to obtain the desirable BET specific surface area.

Examples of other smoothing treatment methods include a plasma method wherein a smoothing treatment is conducted with plasma such as direct current plasma and radio RF-wave plasma generated under the atmosphere of inert gas, and a combustion flame method wherein particles such as ferrite particles are given heat and melted under the atmosphere of gaseous mixture mixed with inflammable gas, such as propane and acetylene, and oxygen at a predetermined rate to conduct a smoothing treatment. Magnetic moment and sphericity can be adjusted at the same time as conducting the smooth treatment by the plasma method and the combustion flame method.

In the plasma method and the combustion flame method, particles, such as ferrite particles, will be in a melting or semi molten state. By cooling the particles in the melting or semi molten state, the surface shape of the particles can be changed greatly. That is, when they are cooled rapidly, many fine crystals will be formed on the surface thereof, resulting in a larger BET specific surface area. Thus, a strict adjustment of a heating/cooling rate is required in the plasma method and combustion flame method.

In addition, phosphorus, bismuth oxide, silica and the like may be added and the grainsize may be enlarged to make the surface of the core material smooth and the BET specific surface area small.

Known magnetic materials, as well as ferrite, can be used for the carrier core material.

The above-mentioned core material particles of the present invention are covered with a resin layer to thereby obtain the electrophotographic carrier. Known resins used for producing the carrier can be used for forming the resin layer. The following resins can be used alone or in combination in the present invention.

Examples thereof include silicone resins; styrene resins such as polystyrene, chloropolystyrene, poly-alpha-methylstyrene, styrene-chlorostyrene copolymers, styrene-propylene copolymers; styrene-butadiene copolymers, styrene-vinylchloride copolymers, styrene-vinylacetate copolymers; styrene-maleic acid copolymers, styrene-esteracrylate copolymers (styrene-methylacrylate copolymers, styrene-ethylacrylate cop olymers, styrene-butylacrylate copolymers, styrene-octylacrylate copolymers, styrene-phenylacrylate copolymers, etc.) and styrene-estermethacrylate copolymers (styrene-methylmethacrylate copolymers, styrene-ethylmethacrylate copolymers, styrene-butylmethacrylate copolymers, styrene-phenylmethacrylate copolymers, etc.); epoxy resins; polyester resins; polyethylene resins; polypropylene resins; ionomer resins; polyurethane resins; ketone resins; ethylene-ethylacrylate copolymers; xylene resins; polyamide resins; phenol resins; polycarbonate resins; melamine resins; etc.

Preferred examples of the silicone resins for coating the carrier include the following resins. Kr271, KR272, KR282, KR252, KR255 and KR152 (available from Shin-Etsu Chemical Co., Ltd.); and SR2400 and SR2406 (available from Dow Corning Toray Silicone Co., Ltd.) Examples of modified-silicone resins include, but are not limited to, epoxy-modified silicone, acrylic-modified silicone, phenol-modifiedsilicone, urethane-modifiedsilicone, polyester-modified silicone and alkyd-modified silicone. A carrier having excellent durability can be obtained by having the silicone resins for coating layers contained an aminosilane coupling agent. Examples of the aminosilane coupling agent used in the present invention include the following compounds shown in Compound Formula 1. The content thereof is preferably in the range of 0.001% by mass to 30% by mass.

Compound Formula 1

| | |
|---|---|
| $H_2N(CH_2)_3Si(OCH_3)_3$ | MW 179.3 |
| $H_2N(CH_2)_3Si(OC_2H_5)_3$ | MW 221.4 |
| $H_2NCH_2CH_2CH_2Si(CH_3)_2(OC_2H_5)$ | MW 161.3 |
| $H_2NCH_2CH_2CH_2Si(CH_3)(OC_2H_5)_2$ | MW 191.3 |
| $H_2NCH_2CH_2NHCH_2Si(OCH_3)_3$ | MW 194.3 |
| $H_2NCH_2CH_2NHCH_2CH_2CH_2Si(CH_3)(OCH_3)_2$ | MW 206.4 |
| $H_2NCH_2CH_2NHCH_2CH_2CH_2Si(OCH_3)_3$ | MW 224.4 |
| $(CH_3)_2NCH_2CH_2CH_2Si(CH_3)(OC_2H_5)_2$ | MW 219.4 |
| $(C_4Hg)_2NC_3H_6Si(OCH_3)_3$ | MW 291.6 |

Examples of methods to form a resin layer on the surface of the carrier core material particle include known methods such as a spray-drying method, a dip coating method and a powder coating method. Particularly, a fluidized bed coater is an effective way to form a uniform coating layer. The resin layer formed on the particulate carrier core material particles usually has a thickness of from 0.02 μm to 1 μm, and it is preferably in the range of from 0.03 μm to 0.8 μm.

The carrier of the present invention can be a resin dispersion carrier, wherein a magnetic powder is dispersed in known resins such as a phenol resin, an acrylic resin and a polyester resin. The carrier of the present invention preferably has resistivity (Log R·Ωcm) in the range of 11.0 to 16.0, and more preferably 12.0 to 15.0. When the resistivity of the carrier is lower than 11.0 and the developing gap (the closest distance between a photoconductor and a developing sleeve) is narrowed, charges will be induced to the carrier particles, resulting in frequent occurrences of carrier adhesions. When linear speeds of the photoconductor and the developing sleeve are fast, the carrier adhesions will occur with a higher frequency. And when the resistivity is higher than 16.0, the carrier tends to be charged with a charge having an opposite polarity to toner, causing frequent occurrences of carrier adhesions. The resistivity of the carrier can be controlled by adjusting the resistivity and thickness of a coated resin layer on the particulate core material particles. The resistivity of the carrier core material (Log R·Ωcm) is preferably in the range of 6.0 to 11.0. When it is smaller than 6.0, frequent occurrences of induced type carrier adhesions will be caused by the uniformity in and over-time abrasion of the carrier coating layers. When the resistivity is larger than 11.0, the developing ability of the carrier may be degraded.

Figure 2:
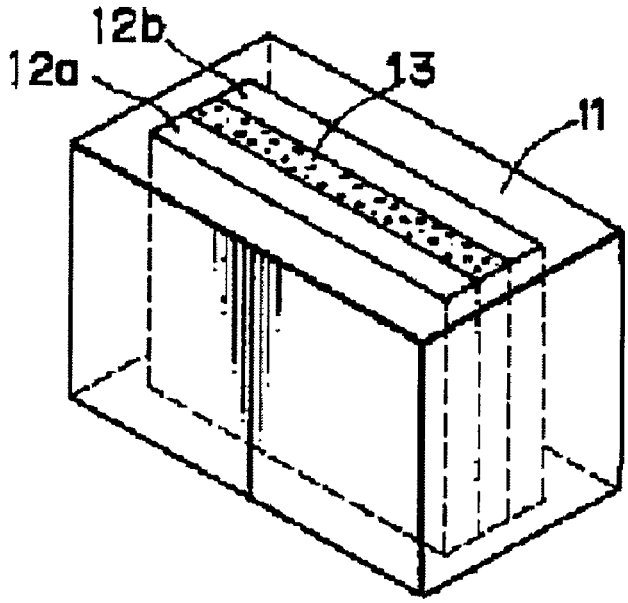
FIG. 2 is a perspective diagram showing an electrical resistivity measurement cell used in the present invention.

The carrier resistivity can be measured by the following method. As shown in FIG. 2, a carrier 13 is filled in a cell 11 formed of a fluorocarbon resin container which contains electrodes 12*a* and 12*b* therebetween having a distance of 2 mm and which are 2×4 cm in surface area, a DC voltage of 100 V is applied therebetween and then DC resistivity is measured with a High Resistance Mater 4329A manufactured by Hewlett-Packard Development Company, L.P. to determine the electric resistivity Log R·Ωcm. After the cell was made full with the carrier, the cell is tapped for 20 times, and then the top of the cell is flatted using a flat nonmagnetic-spatula once. Applying a pressure to the cell during filling the cell with the carrier is not necessary.

Moreover, the resistivity of the carrier can be adjusted by adding an electroconductive fine powder to the resin coating layer. Examples thereof include, but are not limited to, metal or metal oxide powders such as electroconductive ZnO and Al; $SnO_2$ prepared by various methods or doped with various atoms; borides such as $TiB_2$, $ZnB_2$ and $MoB_2$; $SiO_2$; electroconductive polymers such as polyacetylene, polyparaphenylene, poly(paraphenylenesulphide)polypyrrole and polyethylene; and carbon blacks such as furnace black, acetylene black and channel black. After included in a solvent or a resin solution for coating, these electroconductive fine powders can be uniformly dispersed in a disperser using a medium such as a ball mill, a beads mill and a stirrer equipped with a high-speed rotating blade.

In the present invention, the weight-average particle diameter, Dw, of the carrier or the core material thereof is determined according to a particle diameter distribution measured on a number standard (a relation ship between the number frequency and particle diameter). The weight-average particle diameter, Dw, can be determined by the following formula (2):

$$Dw=\{1/\Sigma(nD^3)\}\times\{\Sigma(nD^4)\} \quad (2)$$

where D represents a representative diameter (μm) present in each channel and n represents the total number of particles present therein. The channel is a length equally dividing a scope of particle diameters in the particle diameter distribution, and the length in 2 μm is used for the carrier in the present invention. The representative diameter present in each channel is a minimum particle diameter of the particles present in each channel.

In addition, the number-average particle diameter, Dp, of the carrier or the core material thereof is determined according to the particle diameter distribution measured on a number standard. The number-average particle diameter, Dp, can be determined by the following formula (3):

$$Dp=(1/N)\times\{\Sigma nD\} \quad (3)$$

where N represents the total number of particles measured, "n" represents the total number of particles present in each channel and D represents the minimum particle diameter of the particles present in each channel (2 μm).

A particle size analyzer Microtrac HRA 9320-X100 from Honeywell, Inc. is used to measure the particle diameter distribution of the carrier. The evaluation conditions are as follow.

(1) Scope of particle diameters: 100 μm to 8 μm
(2) Channel length (width): 2 μm
(3) Number of channels: 46
(4) Refraction index: 2.42

The bulk density of the carrier is 2.1 g/cm$^3$ or more, preferably 2.35 g/cm$^3$ or more, more preferably in the range of 2.35 g/cm$^3$ to 2.50 g/cm$^3$, because this is advantageous for preventing carrier adhesion. Carriers having a small bulk density are in general porous or have a surface having large concave-convex.

A smaller bulk density of the carrier is more disadvantageous for preventing carrier adhesion because, even if the carrier has a large amount of magnetization (emu/g) at 1 KOe of magnetic field, the real value of magnetization, magnetization per particle, is reduced.

Higher sintering temperature can enlarge the bulk density; however, core materials sintered with higher temperature melt and agglomerate easily, and do not pulverize easily, and thus the bulk density is preferably less than 2.60. Therefore, a bulk density is normally 2.10 g/cm$^3$ or more, and is preferably in the range of 2.10 g/cm$^3$ to 2.60 g/cm$^3$, more preferably 2.35 g/cm$^3$ to 2.60 g/cm$^3$, and further peferably 2.35 g/cm$^3$ to 2.50 g/cm$^3$.

The density of the present invention is measured as follows. In accordance with JIS-Z-2504, a carrier is made to naturally flow out of an orifice having a diameter of 2.5 mm. The carrier is poured into a stainless cylindrical container having a capacity of 25 cm$^3$ which is located directly below a funnel until the carrier overflows out of the container. Then the carrier is leveled in the container using a flat spatula made of nonmagnetic material.

If the carrier will not flow easily into an orifice having a diameter of 2.5 mm, an orifice having a diameter of 5 mm is used. The carrier weight that flowed into the container is divided by the volume of the container (25 cm$^3$), and then the unit weight of the carrier, weight per 1 cm$^3$ volume, is calculated. This is defined as the bulk density of the carrier in the present invention.

Figure 3:
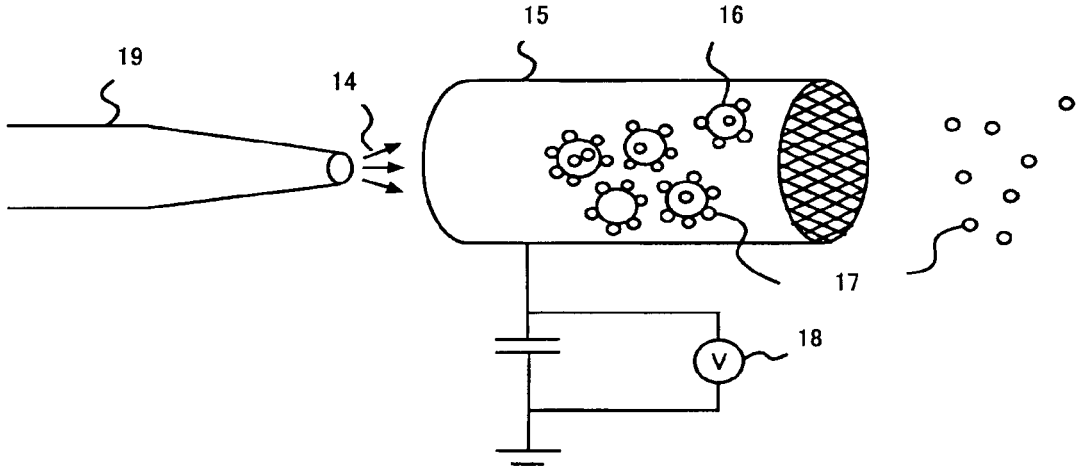
FIG. 3 is a schematic diagram showing a measurement method to measure the electrification amount of the developer of the present invention.

Charging amount of a developer can be measured by the following method. The method is illustrated in FIG. 3. A specific amount of a developer is contained in a conductive container 15 (a blow-off cage) equipped with meshes (made of metal such as stainless steel) at the both side. The size of openings of the meshes is between the diameters of toner particles 17 and that of carrier particles 16, or 20 μm, and thus the toner particles 17 can go through the meshes.

The meshes will be selected from meshes made of stainless steal and having openings larger than particle diameters of the toner 17 and smaller than the carrier 16, or about 20 μm. (I.e. the toner 17 go through the meshes)) The meshes will be selected from meshes made of stainless steal and having openings larger than particle diameters of the toner particles 17 and smaller than the carrier particles 16, or about 20 μm. (i.e. the toner 17 go through the meshes)

When compressed nitrogen gas (1 kgf/cm$^2$=9.8N/cm$^2$) 14 is sprayed into the blow-off cage 15 from a nozzle 19 for 60 seconds in order to blow out the toner particles 17 outside the cage, carrier particles having charges opposite to that of toner particles will remain in the blow-off cage 15. Using an electrometer 18 to measure electrification amount (Q) and the mass (M) of the blown-off toner particles, and based on the obtained values, the electrification amount per unit mass, Q/M, is obtained. The measure of the electrification amount of the toner particles is "μc/g."Next, a toner, which is mixed in the resin-coated magnetic particles prepared by the classification method of the production method of the present invention to prepare a developer, will be explained hereafter. The toner used in the present invention contains a colorant, fine particles, a charging adjuster, a releasing agent and that like in binder resin which mainly made of a thermoplastic resin. Any type of known toners can be employed. The toner can be produced with toner producing methods including a polymerization method and a granulation method, and can be in either an amorphous form or spherical form. And either magnetic toner or non-magnetic toner can be used.

The following materials can be used alone or in combination for the binder resin used for the toner. Examples of materials for styrene binder resins include styrenes and homopolymer derivative substitutions of styrenes, such as polystyrene and polyvinyl toluene, styrene-p-chlorostyrene copolymers, and copolymers of styrenes, such as styrene-propylene copolymers, styrene-vinyltoluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-vinyl methyl ether copolymers, styrene-vinyl methyl ketone copolymers, styrene-butadiene copolymers, styrene -isoprene copolymers, styrene-maleic acid copolymers and styrene-maleic acid ester copolymers, acrylic binders, such as methyl polymethacrylate, butyl polymethacrylate, and others, such as polyvinyl chloride, polyvinyl acetate, polyethylene, polypropylene, polyester, polyurethane, epoxy resin, polyvinyl butyral, polyacrylic acid resins, rosins, modified rosins, terpene resins, phenol resins, alicyclic or aliphatic hydrocarbon resins, aromatic petroleum resins, chlorinated paraffins, and paraffin waxes.

Of these resins, polyester resins are particularly preferable in terms of that the melt viscosity can be reduced while ensuring the storage stability of the toner as compared to styrene resins and acrylic resins. This type of polyesters can be obtained by, for example, the polycondensation reaction between an alcohol and a carboxylic acid. Examples of the alcohols include diols, such as polyethylene glycol, diethylene glycol, triethylene glycol, 1,2-propylene glycol, 1,3-propylene glycol, 1,4-propylene glycol, neopentyl glycol and 1,4-butene diol; etherified bisphenols such as 1,4-bis(hydroxymethyl)cyclohexane, bisphenol A, hydrogenated bisphenol A, polyoxy-ethylenated bisphenol A, polyoxy-propylenated bisphenol A; divalent alcohol monomers wherein each of the above mentioned alcohol components is substituted by a saturated or unsaturated hydrocarbon group having 3 to 22 carbon atoms, other divalent alcohol monomers; and trivalent or more high-alcohol monomers such as sorbitol, 1,2,3,6-hexane tetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylol ethane, trimethylol propane, and 1,3,5-trihydroxymethyl benzene.

Examples of the carboxylic acids used for polyester resins include monocarboxylic acids such as palmitic acid, stearic acid, and oleic acid; maleic acid, fumaric acid, mesaconic acid, citraconic acid, terephthalic acid, cyclohexane dicarboxylic acid, succinic acid, adipic acid, sebacic acid, malonic acid; divalent organic acid monomers that each of the above-noted carboxylic acid components is substituted by a saturated or unsaturated hydrocarbon group having 3 to 22 carbon atoms; anhydrides thereof dimer acids contain a lower alkyl ester and a linolenic acid; 1,2,4-benzene tricarboxylic acid, 1,2,5-benzene tricarboxylic acid, 2,5, 7-naphthalenetricarboxylic acid, 1,2, 4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxylic)methane, 1,2,7,8-octanetetracarboxylic enball trimer acid and trivalent or more polyvalent carboxylic acid monomers of anhydride of those acids.

Examples of the epoxy resins include polycondensation products between bisphenol A and epichlorohydrin etc, and specific examples of commercially available epoxy resins include Epomic R362, R364, R365, R366, R367, and R369 (all manufactured by MITSUI OIL CO., LTD.); Epotote YD-011, YD-012, YD-014, YD-904, and YD-017 (all manufactured by Tohto Kasei Co., Ltd.); and Epocoat 1002, 1004, and 1007 (all manufactured by Shell Chemicals Japan Ltd.).

The colorants used in the present invention include known dyes and pigments, they can be used alone or in combination, and the examples of the dyes and pigments include carbon black, ramp black, iron black, ultramarine blue, nigrosine staining, aniline blue, phthalocyanine, hansa yellow G, rhodamine 6G lake, calco oil blue, chrome yellow, quinacridone, benzin yellow, rose Bengal, triarylmethane stainings, monoazos, disazos, and other types of dyes and pigments.

The toner may be a magnetic toner containing magnetic material. The magnetic material can employ ferromagnetic materials, such as iron and cobalt; and fine particles, such as magnetite fine particles, hematite fine particles, Li ferrite fine particles, Mn—Zn ferrite fine particles, Cu—Zn ferrite fine particles, Ni—Zn ferrite fine particles and Ba ferrite fine particles.

In order to give sufficient control on the frictional electrification of the toner, a charging adjuster, metallic complex amino compounds such as a metal complex salt of monoazo staining, nitrohumic acid and the salt thereof, salicylic acid, naphthoic acid or dicarboxylic acid metallic complex of Co, Cr or Fe, amino compound, quaternary ammonium compound, or organic dye can be contained.

A releasing agent can be added to the toner used in the present invention if necessary. Examples thereof include low-molecular weight polypropylenes, low-molecular weight polyethylenes, carnauba waxes, microcrystalline waxes, jojoba waxes and rice waxes. They can be used alone or in combination for the releasing agent; however, the wax material is not limited to those waxes listed here.

An external additive may be added to the toner. The toner must have a sufficient flowability in order to obtain a high-quality image. To impart flowability to the toner, it is typically effective to add particles such as inorganic particles and hydrophobic-treated inorganic particles, however, the hydrophobic-treated primal particles should preferably contain inorganic particles having the average particle diameter in the range of 1 nm to 100 nm, or preferably 5 nm to 70 nm. Furthermore, the specific surface area measured with a BET method is preferably in the range of 20 $m^2/g$ to 500 $m^2/g$.

The following known materials can be used, provided certain conditions are met. Examples of the inorganic fine particles include fine silica particles, hydrophobized silica, fatty acid metal salts such as zinc stearate and aluminum stearate, metal oxides, such as titania, alumina, tin oxide and antimony oxide, and fluoropolymer particles. Particuraly preferable particles of the external additives include hydrophobized silica, titania, titanic oxide and alumina fine. Examples of silica fine particles include HDKH2000, HDKH2000/4, HDKH2050EP, HVK21, HDKH1303 (all manufactured by Clariant (Japan) K.K.), R972, R974, RX200, RY200, R202, R805, and R812 (all manufactured by NIPPON AEROSIL CO., LTD.). As for titania fine particles, there are, for example, P-25 (manufactured by NIPPON AEROSIL CO., LTD.), STT-30, STT-65C-S (manufactured by Titan Kogyo K.K.), TAF-140 (manufactured by Fuji Titanium Industry Co.Ltd.), MT-150W, MT-500B, MT-600B and MT-150A (manufactured by Tayca Co.Ltd.) As for titanium oxide fine particles subject to hydrophobic processing, there are, for example, T-805 (manufactured by NIPPON AEROSIL CO., LTD.), STT-30A, STT-65S-S (manufactured by Titan Kogyo K.K.), TAF-500T, TAF-1500T (manufactured by Fuji Titanium Industry Co.Ltd.), MT-100S, MT-100T (manufactured by provided by Tayca Co.Ltd) and IT-S (manufactured by Ishihara Sangyo Co.Ltd.). The hydrophobized inorganic fine particles, silica fine particles, titania fine particles and alumina fine particles can be obtained by treating the hydrophilic particles with an aminosilane coupling agent, such as methyl trimethoxy silane, methyl triethoxy silane or octyl trimethoxy silane.

The resin layer, formed on the toner used in the present invention, preferably has a weight average particle diameter, Dt, in the range of from 9.0 μm to 3.0 μm, and preferably from 7.5 μm to 3.5 μm. The content of the toner relative to the carrier is not particularly limited and may be suitably selected in accordance with the intended use; however, it is preferably in the range of 2 parts by mass to 25 parts by mass relative to 100 parts by mass of the carrier, and more preferably 3 parts by mass to 20 parts by mass.

Toner particle diameters were measured using a Coulter counter (manufactured by Beckman Coulter, Inc.).

The image forming method used in the present invention includes steps of forming a toner image on a photoconductor using the developer of the present invention, transferring the toner image on a recording medium, and fixing the toner image transferred on the recording medium. Those steps are processed in the image forming apparatus shown below.

Figure 4:
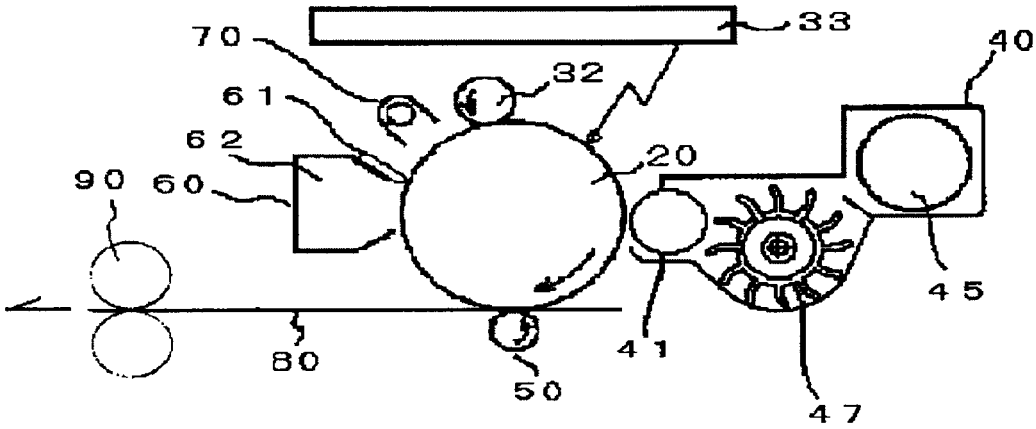
FIG. 4 is a cross sectional plan view schematically showing an image forming apparatus using the image forming method of the present invention.

FIG. 4 is a cross sectional plan view schematically illustrating an image forming apparatus. The image forming apparatus contains at least a photoconductor (or a photoconductor drum) 20 serving as an image bearing member; a charging unit 32 for charging the surface of the photoconductor 20; an exposing unit 33; a developing unit 40; a fixing unit 50; a cleaning unit 60; a charge-elimination unit 70; and a fixing unit 90.

The charging unit 32 involves, for example, a charge blush, an electric charger or a charge roller. The charging unit 32 is to charge the surface of the photoconductor 20. There is a clearance between the surface of the charging unit 32 and the photoconductor 20, so that they are not in a contact state. During charging, voltage will be applied to the charging unit 32 using a voltage imposing unit (not shown). Application of voltage will thus electrify the surface of the photoconductor 20. Additionally, charge exsisting on the surface of the photoconductor 20 will be eliminated using the charge-elimination unit 70, which includes a charge elimination lamp, before applying voltage.

Thus electrified surface of the photoconductor 20 will be then exposed by the exposing unit 33, such as a semiconductor laser. Exposing light (a laser beam) emitted from the exposing unit 33 is modulated corresponding to picture information to thereby form a latent electric field image on the surface of the photoconductor 20 after the exposure.

Figure 5:
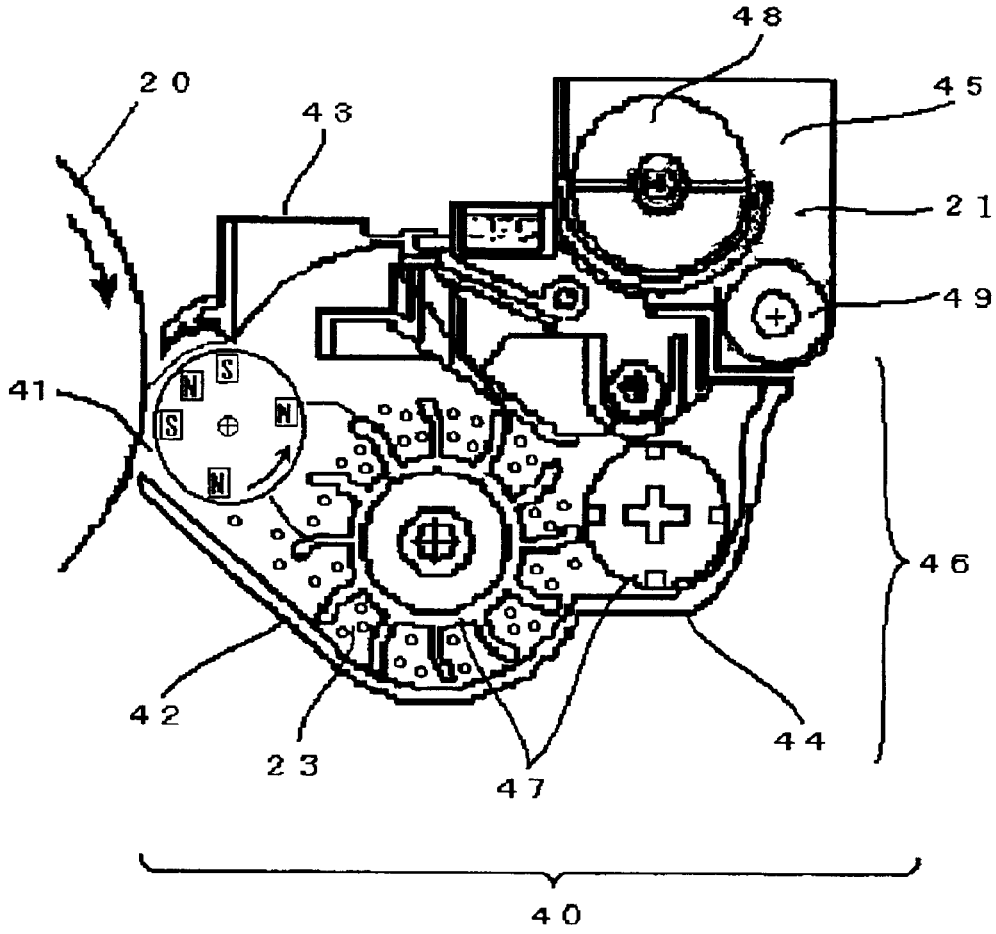
FIG. 5 is a cross sectional plan view schematically showing a developing section of the image forming apparatus using the image forming method of the present invention.

The latent electric field image thus formed on the surface of the photoconductor 20 will be then developed with a developing section 40. FIG. 5 is a cross sectional plan view schematically illustrating a developing section. The developing section 40 is placed facing a photoconductor 20. The developing section 40 is mainly composed of a developing sleeve 41 serving as a developer bearing member, a developer housing member 42, a doctor blade 43 and a supporting case 44.

The supporting case 44 has an opening which is located beside the photoconductor 20. A toner hopper 45 is jointed to the supporting case 44. The toner hopper 45 has a toner housing member in which toner 21 is contained. A developer housing section 46, serving to contain a developer composed of a toner 21 and a carrier 23, is located beside the toner hopper 45A developer agitating mechanism 47, which is to agitate the toner 21 and carrier 23 and to apply friction/stripping charge thereto, is contained in the developer housing section 46.

The toner hopper 45 contains a toner agitator 48, which is driven with a driving unit (not shown) and serves as a toner supplying unit, and a toner supplying mechanism 49. The toner 21 contained in the toner hopper 45 will be aggitated with the toner agitator 48, and then toner supplying mechanism 49 will carry the toner 21 to the developer housing section 46. A developing sleeve 41 is located between the photoconductor 20 and the toner hopper 45. The developing sleeve 41 is driven with a driving method (not shown) in the direction indicated by the arrow head shown in the drawing of the developing sleeve 41 in FIG. 4. The developing sleeve 41 has two or more magnets (not shown) serving as a magnetic-field generator. A magnetic brush will be formed from carrier 23 on the surface of the developing sleeve 41. The doctor blade 43, serving as a regulation member, is integrally provided to the supporting case 44. The doctor blade 43 is placed to face the developer housing member 42 which is attached to the supporting case 44. The doctor blade 43 is arranged to maintain a constant clearance between its edge and the outer circumference surface of the developing sleeve 41.

The toner 21 contained in the toner hopper 45 will be carried to the developer housing section 46 with the toner agitator 48 and toner supplying mechanism 49. Then, the toner 21 and carrier 23 will be then agitated with the developer agitating mechanism 47 to thereby apply desired friction/stripping charge. The developer that is composed of the toner 21 and carrier 23 to which thereby desired charge has been applied, will be then carried to the surface of the developing sleeve 41. The turning developing sleeve 41 will then provide developer to the position nearest to the photoconductor 20. At the position, toner particles of the toner 21 in developer will move onto a latent electric field image, formed on the photoconductor 20, by electrostatical force. As a result, a visualized toner image will be formed on the photoconductor 20.

A recording medium 80, such as a sheet of paper, fed from a sheet feeding mechanism (not shown), will be provided in between the photoconductor 20 and a transfer unit (a transfer roller) 50 to thereby transfer thereto the toner image formed on the photoconductor 20. Then, the toner image thus transferred on the recording medium 80 will be fixed thereon with a fixing unit 90, which includes a heat application roller and a pressure application roller. The recording medium 80 will be then ejected after the toner image has been fixed.

Toner particles remaining on the surface of the photoconductor 20 will be removed with a cleaning blade 61, which is included in the cleaning unit 60. Thus removed toner particles will be collected and kept in a toner recovery chamber 62. Or the toner particles will be carried to the developing section 40 using a toner recycling unit (not shown) in order to be reused.

The image forming apparatus is not limited to be used in a monochrome system, but it may also be used in a full-color system. The image forming method of the present invention can be conducted using a different apparatus.

EXAMPLES

The present invention will be described in further detail by way of Examples and Comparative Examples. They are, however, not intended to limit the scope of the present invention. The terms "part" and "parts" refer to "parts by mass."

Toner Production Example 1

100 parts of a polyester resin
4.0 parts of a quinacridone magenta pigment
3.0 parts of a fluorine-containing quaternary ammonium salt The above-stated compositions were sufficiently mixed using a blender, melted/kneaded using a biaxial extruder, crushed using a cutter mill after stood for cooling, pulverizined using a jet-stream pulverizing mill and classified using an air classification machine to thereby obtain toner mother particles having weight average particle diameter of 6.2 μm.

To 100 parts of the toner mother particles, 1.0 parts of hydrophobitic silica fine particles (R972, manufactured by NIPPON AEROSIL CO., LTD.) were added, and they were mixed using a HENSCHEL Mixer to thereby obtain Toner I.

Core Material Production Example 1

60 mol % of $Fe_2O_3$
40 mol % of $MnO_2$

Ferrite raw material composed of the above-stated oxides with the compounding ratios was treated in a wet blending process using a bead mill, and then the mixture was dried and crushed. The crushed mixture was temporally baked in a calcination process at 850° C. for 1 hour, and then it was treated in a wet grinding process using the bead mill to thereby form it into slurry. To thus obtained slurry, polyvinyl alcohol amounting 0.7% of that slurry was added as a binder. It was then treated in a spray dryer method to be formed into spherical particles. Thus obtained particles were baked at 1,150° C. for 2 hours to thereby obtain ferrite particles.

The obtained ferrite particles were put into a rotary kiln at 1,270° C. to perform a smoothing treatment to the surface thereof.

That ferrite particles treated with the smoothing were classified, and thus Core Material 1 was obtained. Core Material 1 had the weight average particle diameter (Dw) of 25.5 μm, the ratio of the Dw to the number average particle diameter (Dp), Dw/Dp, of 1.28, the content of particles having diameters smaller than 20 μm of 25.3% by mass and smaller than 36 μm of 96.1% by mass, and the BET specific surface area of 350 $cm^2/g$. The magnetic moment of the core material 1 was 65 emu/g at 1 KOe.

Core Material Production Example 2

Except the smoothing treatment was conducted at 1,210° C. for 3 hours, ferrite particles were produced in the same manner as Production Example 1. The particles were classified to thereby obtain Core Material 2. Core Material 2 had the Dw of 25.6 μm, the ratio of the Dw to Dp, Dw/Dp, of 1.27, the content of particles having diameters smaller than 20 μm of 25.6% by mass and smaller than 36 μm of 96.8% by mass, and the BET specific surface area of 880 $cm^2/g$. The magnetic moment of Core Material 2 was 65 emu/g at 1 KOe.

Core Material Production Example 3

Except the smoothing treatment was conducted at 1,300° C. for 3 hours, ferrite particles were produced in the same manner as Production Example 1. The particles were classified to thereby obtain Core Material 3. Core Material 3 had the Dw of 25.3 μm, the ratio of the Dw to Dp, Dw/Dp, of 1.30, the content of particles having diameters smaller than 20 μm of 26.1% by mass and smaller than 36 μm of 97.1% by mass, and the BET specific surface area of 180 $cm^2/g$. The magnetic moment of Core Material 3 was 65 emu/g at 1 KOe.

Core Material Production Example 4

Except the smoothing treatment was conducted at 1,240° C. for 3 hours, ferrite particles were produced in the same manner as Production Example 1. The particles were classified to thereby obtain Core Material 4. Core Material 4 had the Dw of 25.6 μm, the ratio of the Dw and Dp, Dw/Dp, of 1.27, the content of particles having diameters smaller than 20 μm of 24.3% by mass and smaller than 36 μm of 96.7% by mass, and the BET specific surface area of 510 $cm^2/g$. The magnetic moment of Core Material 4 was 65 emu/g at 1 KOe.

Core Material Production Example 5

Except the smoothing treatment using the rotary kiln was not conducted, ferrite particles were produced in the same manner as Production Example 1. The particles were classified to thereby obtain Core Material 5. Core Material 5 had the Dw of 25.4 μm, the ratio of the Dw to Dp, Dw/Dp, of 1.28, the content of particles having diameters smaller than 20 μm of 25.7% by mass and smaller than 36 μm of 96.6% by mass, and the BET specific surface area of 1,100 $cm^2/g$. The magnetic moment of Core Material 5 was 65 emu/g at 1 KOe.

Core Material Production Example 6

A classification, in which Core Material 4 (Mn ferrite, 65 emu/g and BET specific surface area of 510 $cm^2/g$) was provided on a stainless steel mesh at a supplying rate of 1 Kg/min, was conducted.

In the classification, Vibrating Screen 1 having the mechanism shown in FIG. 1 was used. Vibrating Screen 1 had a stainless steel mesh, which was 70 cm in diameter and provided on the flame 9 located in the cylindrical container 2 and had openings of 20 μm (635 mesh and mesh opening rate of 25%). On the stainless steel mesh, the resonant ring 6 serving as a resonant member was provided. Furthermore, the transducer 8, oscillating 36 kHz supersonic waves, was provided on the ring 6.

The base 4 contains a vibration motor (not shown). The vibration motor generates vibration in the base 4, and generated vibration is transmitted through the springs and vibrates the vibrating screener 1. Additionally, high-frequency current generated from the converter (not shown) is transmitted to the transducer 8 fixed to the resonant ring 6 through the cable 7, and the transducer 8 generates ultrasonic vibration. That ultrasonic vibration vibrates the resonant ring 6 to thereby vertically vibrate the entire mesh 5. Finer particles of Core Material 4 supplied on the 193 GPa stainless steel mesh 5 in the cylindrical container 2 was received sieve disposal, and were accumulated in the lower part of the cylindrical container 2 under the mesh. This classification was repeated to thereby obtain Core Material 6. Core Material 6 having the ratio of particles smaller than 20 mμ in diameter at 9.4% was obtained from the classification. In addition, when the level of clogging of the stainless steel mesh was examined after the experiment, the rate of hole-area of the stainless steel mesh was 14%, and the mesh had 11% of clogging.

Core Material Production Example 7

In the vibrating screen 1 shown in FIG. 1, two or more meshes were used to configure the meshes expressed with the code 5. That is, (150 mesh) a stainless steel mesh having openings of 104 μm was installed in the bottom, and a polyamide mesh having openings of 20 μm (14% of rate of hole-area) was layered on the stainless steel mesh. The bending elastic modulus of the material (nylon-66) used for the polyamide mesh is 2.7 GPa. Although only the stainless steel mesh installed as a lower layer receives the vibration from the ultrasonic transducer directly, since an upper polyamide mesh layered on the lower stainless steel mesh, supersonic oscillation can be efficiently transmitted to the upper polyamide mesh, and thus the upper mesh can efficiently classify the particles with desired diameters. Using this vibrating screen 1, Core Material 4 (Mn ferrite, 65 emu/g, BET surface area of 510 $cm^2/g$) was classified with a supplying rate of 1 kg/min. on the polyamide mesh to thereby obtain Core Material 7.

As a result, Core Material 7 having the ratio of particles smaller than 20 μm in diameter at decreased from 24.3% to 5.6% was obtained from the classification. The particle size distribution of Core Material 7 is shown in Table 1.

In addition, the polyamide mesh after the classification had almost no clogging, and maintained the rate of hole-area at 13% or more (namely, less than 1% of clogging).

Core Material Production Example 8

Core Material 3 was classified using the polyamide mesh of Production Example 7, and Core Material 8 was obtained. Clogging during the classification was 16%. The particle diameter distribution of obtained Core Material 8 is shown in Table 1.

Core Material Production Example 9

Core Material 5 was classified using the polyamide mesh of Production Example 7, and Core Material 9 was obtained. Clogging during the classification was 1%. The particle diameter distribution of obtained Core Material 9 is shown in Table 1.

Core Material Production Example 12

Except a mesh made of GF30% consolidation polyethylene terephthalate was layered on the stainless steal mesh as an upper mesh, Core Material 12 was obtained in the same manner as Production Example 7. Clogging during the classification was 15%. The particle diameter distribution of obtained Core Material 12 is shown in Table 1.

Core Material Production Example 13

In the vibrating screen 1 shown in FIG. 1, a stainless steal mesh having openings of 104 μm (150 mesh) was installed as a lower mesh and thereon a polyester mesh having openings of 32 μm (rate of hole-area at 21%) was layered to configure the meshes 5. Core Material 7 obtained in Production Example 7 was classified in the same manner as Production Example 7 to thereby obtain Core Material 13. In order to remove coarse particles, Core Material 13 was collected under the stainless mesh 5 which is in the cylindrical container 2. Clogging during the classification was 1%. The particle diameter distribution of obtained Core Material 13 is shown in Table 1.

Core Material Production Example 14

Core Material 1 was classified using the polyamide mesh of Production Example 7, and Core Material 14 was obtained.

TABLE 1

| Core Material Production Examples | Core Materials | Dw (μm) | Dp (μm) | Content of Particles 20 μm or smaller (% by mass) | Content of Particles 36 μm or smaller (% by mass) | Dw/Dp | BET specific surface area ($cm^2/g$) |
|---|---|---|---|---|---|---|---|
| Ex. 1 | 1 | 25.5 | 19.9 | 25.3 | 96.1 | 1.28 | 350 |
| Ex. 2 | 2 | 25.6 | 20.2 | 25.6 | 96.8 | 1.27 | 880 |
| Ex. 3 | 3 | 25.3 | 19.5 | 26.1 | 97.1 | 1.30 | 180 |
| Ex. 4 | 4 | 25.6 | 20.1 | 24.3 | 96.7 | 1.27 | 510 |
| Ex. 5 | 5 | 25.4 | 19.8 | 25.7 | 96.6 | 1.28 | 1100 |
| Ex. 6 | 6 | 28.5 | 24.6 | 9.4 | 86.6 | 1.16 | 480 |
| Ex. 7 | 7 | 28.6 | 25.4 | 5.6 | 91.8 | 1.13 | 470 |
| Ex. 8 | 8 | 28.4 | 25.3 | 5.8 | 91.5 | 1.12 | 170 |
| Ex. 9 | 9 | 28.7 | 25.5 | 5.5 | 91.9 | 1.13 | 1070 |
| Ex. 10 | 10 | 28.8 | 25.7 | 4.7 | 91.6 | 1.12 | 460 |
| Ex. 11 | 11 | 28.3 | 24.9 | 5.7 | 90.6 | 1.14 | 490 |
| Ex. 12 | 12 | 28.2 | 24.6 | 6.4 | 90.7 | 1.15 | 500 |
| Ex. 13 | 13 | 27.2 | 25.0 | 6.1 | 98.0 | 1.09 | 480 |
| Ex. 14 | 14 | 28.3 | 25.0 | 5.0 | 91.1 | 1.13 | 330 |
| Ex. 15 | 15 | 28.4 | 24.9 | 4.9 | 91.2 | 1.14 | 860 |

Core Material Production Example 10

Except a mesh (having openings of 20 μm, 14% of rate of hole area and bending elastic modulus of 2.6 GPa) made of polyether sulfone was layered on the stainless steal mesh as an upper mesh, Core Material 10 was obtained in the same manner as Production Example 7. Clogging during the classification was 1%. The particle diameter distribution of obtained Core Material 10 is shown in Table 1.

Core Material Production Example 11

Except a mesh (bending modulus of 0.8 GPa) made of ultrahigh-molecular-weight polyethylene was layered on the stainless steal mesh as an upper mesh, Core Material 11 was obtained in the same manner as Production Example 7. Clogging during the classification was 14%. The particle diameter distribution of obtained Core Material 11 is shown in Table 1.

Clogging during the classification was 5%. The particle diameter distribution of obtained Core Material 14 is shown in Table 1.

Core Material Production Example 15

Core Material 2 was classified using the polyamide mesh of Production Example 7, and Core Material 15 was obtained. Clogging during the classification was 1%. The particle diameter distribution of obtained Core Material 15 is shown in Table 1.

The characteristics, such as BET surface area, of the core materials 1 to 15 are shown in Table 1.

Carrier Production A-K

To a silicone resin (SR2411 manufactured by Dow Corning Toray Silicone), a carbon black (Ketjenblack EC-DJ600 manufactured by lion Akzo Co. Ltd.) amounting 5% of the resin solid content was dispersed by mixing them for 60 minutes using the ball mill. Thus obtained dispersion liquid was diluted, and a dispersion liquid with 5% of solid content was obtained.

Further, an amino silane coupling agent ($NH_2$ $(CH_2)_3Si$ $(OCH_3)$) amounting 3% of the solid content of the silicone resin was added and blended to the dispersion liquid to thereby obtain a dispersion liquid.

A fluidized bed coater was used to form coating layers on the particle surface of each 5 Kg of Core Materials 4, 6 to 15 shown in Table 1 from the dispersion liquid at 100° C. with a coating rate of about 30 g/min., and the coated they were heated at 200° C. for 2 hours to thereby obtain resin-coated Carriers A to K. The thickness of the layers was controlled by adjusting the amount of the coating liquid. The particle diameter distributions of Carriers to K are shown in Table 2.

TABLE 2

| Carrier Production Examples | Carriers Used | Core Material Used | Dw (μm) | Dp (μm) | Content of Particles 20 μm or smaller (% by mass) | Content of Particles 36 μm or smaller (% by mass) | Dw/Dp |
|---|---|---|---|---|---|---|---|
| Ex. 1 | A | 14 | 28.7 | 25.4 | 5.1 | 91.5 | 1.13 |
| Ex. 2 | B | 15 | 28.8 | 25.5 | 5.3 | 91.4 | 1.13 |
| Ex. 3 | C | 4 | 26.0 | 20.3 | 24.1 | 96.9 | 1.28 |
| Ex. 4 | D | 6 | 28.8 | 24.7 | 9.6 | 86.3 | 1.17 |
| Ex. 5 | E | 7 | 28.9 | 25.7 | 5.4 | 91.3 | 1.12 |
| Ex. 6 | F | 8 | 28.7 | 25.6 | 5.3 | 91.1 | 1.12 |
| Ex. 7 | G | 9 | 29.1 | 25.9 | 5.2 | 90.7 | 1.12 |
| Ex. 8 | H | 10 | 29.1 | 25.9 | 5.3 | 90.9 | 1.12 |
| Ex. 9 | I | 11 | 28.7 | 25.2 | 5.4 | 91.3 | 1.14 |
| Ex. 10 | J | 12 | 28.5 | 24.9 | 6.6 | 90.4 | 1.14 |
| Ex. 11 | K | 13 | 27.8 | 25.2 | 5.8 | 94.3 | 1.10 |

<Production and Evaluation of Developer>

To obtain developers, 10 parts of Toner I obtained in Production Example 1 and 100 parts of Carriers A to K obtained in Production Examples 1 to 11 were mixed using a mixer for 10 min.

Image forming processes were conducted using the obtained developers, and resultant image qualities (occurence of background smears and granularity) and carrier adhesion margins were tested. The image forming processes were conducted with Imagio Color 4000 (a digital color photocopier/printer complex unit, manufactured by Ricoh Co. Ltd.) under the following conditions.

Developing gap (the distance between the photoconductor and developing sleeve): 0.35 mm Doctor gap (the distance between the developing sleeve and doctor): 0.65 mm Linear speed of the photoconductor: 200 mm/sec The ratio of the linear speed of the developing sleeve to the linear speed of the photoconductor: 1.80

Writing density: 600 dpi

Charge potential (Vd): −600V

Electrical potential (V1) of an image portion (fill manuscript) after exposure: −150V Developing bias: DC component −500V/alternate current bias component: 2 kHz, −100V to −900V, 50% duty Examination methods used in following Examples of image forming are as follows:

(1) Developing torque: developing torque when 700 g of a developer is contained in the developing apparatus was measured. A letter, D, shall represent remarkably high values of the developing torque.

(2) Background smear: occurrence of smears in background portions of an image was visibly observed and evaluated. The letters in Table 3 shall mean:

A: Excellent

B: Good

C: Allowable to use

D: Poor (or unallowable to use)

(3) Uniformity of highlight portions: value of granularity (brightness range of 50 to 80), defined by the following formula, was measured on transfer paper. Obtained values were converted into ranks as follows:

$$\text{Granularity}=\exp(aL+b)\int(WS(f))^{1/2}VTF \qquad (f)df$$

L: average brightness f: spatial frequency (cycle/mm)

WS (f): power spectrum of brightness variation

VTF (f): visual characteristics of spatial frequency a and b: coefficients

Rank:

A: Excellent (0 or more and less than 0.1)

B: Good (0.1 or more and less than 0.2)

C: Allowable to use (0.2 or more and less than 0.3)

D: Poor (unallowable level, 0.3 or more)

(4) Carrier adhesion: when carrier adhesion occurs, it will cause flaws of a photoconductor drum and/or a fixing roller, resulting in degradation of image quality. Because only a portion of adhering carrier particles transferes on paper, transfer was conducted from the photoconductor drum using an adhesive tape and evaluated.

The image pattern of two dot lines (100 lpi/inch) was created in a vertical scanning direction, and a voltage of −400V was applied as a DC bias component and developed, and the number (area of 100 $cm^2$) adhesive tape of the carrier which adhered between the lines of two dot lines was transferred to visually observe and evaluate the number.

The evaluation was conducted with the following criteria and the result is shown in Table 3.

A: Excellent

B: Good

C: Allowable to use

D: Poor (unallowable level)

(5) occurrence of background smears after running 50,000 sheets of paper:

With supplying a magenta toner I used for carrying out initial image forming processes, image formings of 50,000 sheets of paper were performed with a character/image chart with a 6% of image occupancy. Occurrence of background smears in background portions was evaluated using the same rank as (2) under the above-stated developing conditions.

The quality evaluation result in each Example and Comparative Example is shown in Table 3.

(6) Clogging area rate (%)=Hole-area rate (%) of mesh−hole-area rate (%) of mesh after classification

TABLE 3

| | | Results of Quality Evaluation of Developers | | | | | |
|---|---|---|---|---|---|---|---|
| | | | | | | Quality After Running 50,000 Sheets | |
| | | Initial Quality | | | | | Stability in Supply |
| | Carriers Used | Developing Torque | Background Smears | Granularity | Carrier Adhesion | Background Smear | Amount of Developer |
| Production Ex. 1 | A | B | B | B | B | B | B |
| Production Ex. 2 | B | C | B | B | B | C | C |
| Production Ex. 3 | E | B | B | B | B | B | B |
| Comparative Ex. 1 | C | B | D | D | D | D | D |
| Comparative Ex. 2 | D | B | D | D | D | D | C |
| Comparative Ex. 3 | F | B | B | C | C | C | C |
| Comparative Ex. 4 | G | D | B | C | B | D | D |
| Production Ex. 4 | H | B | B | B | B | B | B |
| Production Ex. 6 | I | B | B | B | B | B | B |
| Production Ex. 7 | J | B | B | B | B | B | B |
| Production Ex. 5 | K | B | A | A | A | B | A |

INDUSTRIAL APPLICABILITY

The present invention is to provide a production method that can efficiently produce a small diameter electrophotographic carrier, which can provide better image quality and particularly better granularity and prevent occurrence of carrier adhesions and has a narrow particle diameter distribution, and further to provide an electrophotographic two-component developer that can provide better image quality.

What is claimed is:

1. A carrier for an electro photographic developer, comprising:

magnetized core material particles and a resin layer covering each surface thereof, wherein the weight average particle diameter, Dw, of the core material particles is in the range of 22 μm to 32 μm, the ratio of Dw to the number average particle diameter, Dp, satisfies the condition, $1<Dw/Dp<1.20$, the content of particles smaller than 20 μm in diameter is in the range of 0% by mass to 7% by mass, the content of particles smaller than 36 μm in diameter is in the range of 90% by mass to 100% by mass, and the BET specific surface area of the core material particles is in the range of $300cm^2/g$ to $500cm^2/g$, and wherein the core material particles comprise ferrite a surface of which is treated with a smoothing treatment obtained by calcinating particles of metal oxides in a rotary kiln.

2. The carrier according to claim 1, wherein the BET specific surface area of the core material particles is in the range of $460cm^2/g$ to $500cm^2/g$.

3. An electro photographic developer, comprising:

a toner and a carrier, wherein the carrier comprises magnetized core material particles and resin layers covering the surface thereof, wherein the weight average particle diameter, Dw, of the core material particles is in the range of 22 μm to 32 μm, the ratio of Dw to the number average particle diameter, Dp, satisfies the condition, $1<Dw/Dp<1.20$, the content of particles smaller than 20 μm in diameter is in the range of 0% by mass to 7% by mass, the content of particles smaller than 36 μm in diameter is in the range of 90% by mass to 100% by mass, and the BET specific surface area of the core material particles is in the range of $300cm^2/g$ to $500cm^2/g$, and wherein the core material particles comprise ferrite a surface of which is treated with a smoothing treatment obtained by calcinating particles of metal oxides in a rotary kiln.

4. The electro photographic developer according to claim 3, wherein the BET specific surface area of the core material particles is in the range of $460cm^2/g$ to $500cm^2/g$.

* * * * *